United States Patent [19]

Grögl et al.

[11] Patent Number: 4,810,834

[45] Date of Patent: Mar. 7, 1989

[54] TENSIONPROOF CABLE

[75] Inventors: Ferdinand Grögl, Oberstenfeld; Wolfgang Schmidt, Leonberg, both of Fed. Rep. of Germany

[73] Assignee: Alcatel N.V., Amsterdam, Netherlands

[21] Appl. No.: 122,774

[22] Filed: Nov. 19, 1987

[30] Foreign Application Priority Data

Nov. 20, 1986 [DE] Fed. Rep. of Germany ..... 3639703

[51] Int. Cl.[4] ..... H01B 7/00; H01B 11/00

[52] U.S. Cl. ..... 174/121 R; 174/121 SR

[58] Field of Search ..... 174/121 R, 121 SR, 107; 57/217, 221, 223, 232

[56] References Cited

U.S. PATENT DOCUMENTS

| | | | |
|---|---|---|---|
| 3,903,354 | 9/1975 | Dageforde | 174/107 |
| 4,197,423 | 4/1980 | Fusen | 174/107 |
| 4,312,260 | 1/1982 | Morieras | 174/121 R X |
| 4,710,594 | 12/1987 | Walling et al. | 174/121 R X |

FOREIGN PATENT DOCUMENTS

| | | | |
|---|---|---|---|
| 3414638 | 11/1986 | Fed. Rep. of Germany | 174/121 R |
| 131791 | 10/1979 | Japan | 174/121 R |
| 244944 | 12/1925 | United Kingdom | 174/121 R |
| 266855 | 3/1927 | United Kingdom | 174/121 R |
| 830644 | 3/1960 | United Kingdom | 174/121 SR |

*Primary Examiner*—Morris H. Nimmo

*Attorney, Agent, or Firm*—Christie, Parker & Hale

[57] ABSTRACT

The disclosed communications cables have tensionproof jackets which consist of tensionproof and axial-compression-resistant tape and an outer plastic covering extruded over the tape. The tape includes lengthwise threads of aramid or glass, lengthwise threads of aramid- or glass-fiber-reinforced plastic or a liquid-crystal polymer, and cross threads of a different plastic material. It may be designed as a open-mesh tape. The tape has a longitudinal seam which may deviate in alternating direction from the longitudinal axis of the cable by a small angle to improve flexibility.

6 Claims, 2 Drawing Sheets

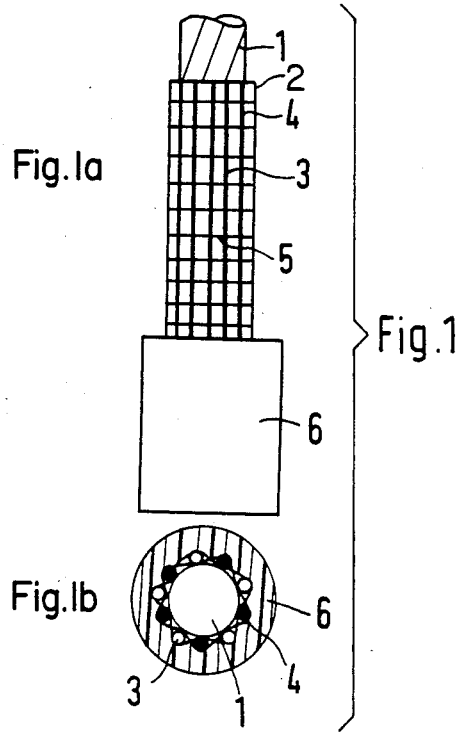
Fig.1a
Fig.1b
1
2
4
3
5
6
6
4
3
1
Fig.1
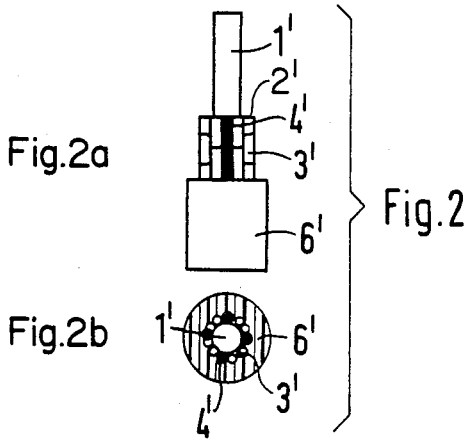
Fig.2a
Fig.2b
1'
2'
4'
3'
6'
1'
6'
3'
4'
Fig.2

TENSIONPROOF CABLE

TECHNICAL FIELD

The present invention relates to a cable with a tensionproof communications cable jacket.

BACKGROUND ART

An exemplary prior art cable with a tensionproof cable jacket is disclosed in published German patent application DE-OS 34 14 638. It contains a tensionproof open-mesh tape which consists of longitudinal aramid threads and cross threads of another plastic, and over which an outer plastic covering is extruded. When the latter shrinks, the tensionproof tape becomes wavy, so that subsequently applied tensile forces will not be absorbed by the tape until the latter has been completely straightened.

DISCLOSURE OF INVENTION

The present invention provides an improved tensionproof cable having a nonshrinkable, tensionproof cable jacket.

To that end, the tensionproof tape contains tensionproof and axial-compression-resistant lengthwise threads of glass- or aramid-fiber-reinforced plastic, a liquid-crystal polymer, or a glass- or aramid-fiber-reinforced liquid-crystal polymer.

In accordance with presently preferred embodiments, the tensionproof element encircles the central core of the cable and is formed from a longitudinally extending open-mesh tape or a tape having practically no gaps between the lengthwise threads; a longitudinal butt seam of the tape may deviate from the cable axis at a small angle, with the deviation alternating in direction. The novel cable can be manufactured easily and at low cost. In the case of cables in which the jacket construction is not stable against axial compression, such as indoor cables, axial-compression resistance is increased without appreciably reducing flexibility. As high-tensile-strength and axial-compression-resistant elements are combined in one tape, overhead cables, in particular, can be manufactured with high tensile strength and small diameter, i.e., in a weight-saving manner, which results in a great maximum span length.

BRIEF DESCRIPTION OF DRAWINGS

In the accompanying drawing,

FIG. 1 (comprising longitudinal cutaway view 1*a* and cross-sectional view 1*b*) shows schematically the construction and a cross-section of a first embodiment having an open-mesh tape;

FIG. 2 (comprising longitudinal cutaway view 2*a* and cross-sectional view 2*b*) shows schematically the construction and a cross-section of a second embodiment having another type of tape.

BEST MODE FOR CARRYING OUT THE INVENTION

Figure 3:
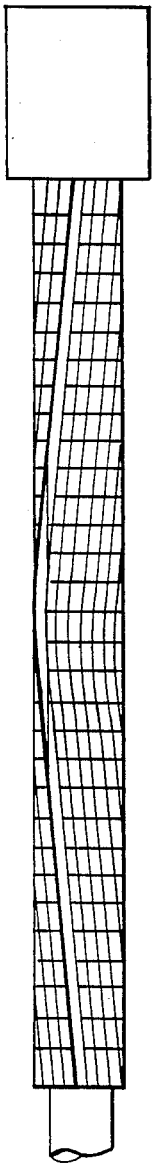
FIG. 3 shows schematically the construction of a third embodiment in which the longitudinal seam of the tape deviates from the longitudinal axis of the cable by a small amount.

The invention will now be explained with reference to the two presently preferred embodiments shown in the drawings. Alternative embodiments will also be noted.

The cable of FIG. 1 contains a cable core 1 of a conventional construction familiar to those skilled in the art. Encircling the cable core with a longitudinal butt seam is an open-mesh tape 2 consisting of parallel lengthwise threads 3, 4 and cross threads 5. A portion 3 of the lengthwise threads may be tensionproof aramid or glass threads, the remaining portion 4 are tensionproof and axial-compression-resistant threads of aramid- or glass-fiber-reinforced plastic (such as LLS-045 of Neptco, USA), a liquid-crystal polymer (such as Vektra B900 of Celanese), or an aramid- or glass-fiber-reinforced liquid-crystal polymer. The cross threads 5 are made of any suitable plastic. Extruded over the tape is an outer plastic covering 6 which embeds the threads of the open-mesh tape or fuses with the cross threads 5 if the material of the latter is the same as that of the outer plastic covering 6.

As shown in FIG. 2, the cable core 1' is of the type known as "loose tube single fiber" (alternatively, it may be of the type "loose tube multiple fiber"); encasing the cable core is a tape 2' consisting of parallel lengthwise threads 3', 4' and cross threads 5'. The tape 2' is of the same construction as the open-mesh tape 2 except that it has no gaps between the lengthwise threads 3', 4'. An outer plastic covering 6' is applied over this tape.

It is to be noted that, as shown in FIG. 3, the tapes 2, 2' may be placed around the cable core 1, 1' at a small angle (greater than 0° and less than 10° and preferably between 1° and 5°) to the cable's axis to as to produce a helical longitudinal seam which, after the helix has completed about half a turn, reverses in direction. Such an alternating helical construction has a greater flexibility without any significant reduction in tensile strength and axial-compression resistance.

The present invention has been described above with regard to the certain presently contemplated specific embodiments of the invention. It will be appreciated to those skilled in the art that modifications and variations thereof are possible within the spirit and scope of the appended claims.

What is claimed is:

1. A communications cable assembly comprising a cable core;

a tensionproof and axial-compression-resistant tape encircling said core and having a longitudinal butt seam extending in the axial direction of the cable assembly, said tape comprising a plurality of tensionproof and axial-compression-resistant straight threads extending in the longitudinal direction of the tape, said threads being made from the group consisting of glass-fiber-reinforced plastics, aramid-fiber-reinforced plastics, liquid-crystal polymers, glass-fiber-reinforced liquid-crystal polymers, and aramid-fiber-reinforced liquid-crystal polymers; and a plastic covering extruded over said tape, wherein said threads remain straight and will absorb any applied tensile forces despite any tendency for the extruded covering to shrink.

2. A cable as claimed in claim 1, wherein said tape is open-mesh.

3. A cable as claimed in claim 1, wherein said tape has practically no gaps between its lengthwise threads.

4. A cable as claimed in claim 1, wherein said longitudinally extending seam deviates from the cable axis at a small angle of alternating sign.

5. A cable as claimed in claim 4, wherein said angle is less than 10°.

6. A cable as claimed in claim 5, wherein said angle is between 1° and 5°.

* * * * *